US007184369B2

(12) United States Patent
Crettex

(10) Patent No.: US 7,184,369 B2
(45) Date of Patent: Feb. 27, 2007

(54) DATE INDICATOR MECHANISM FOR WATCH MOVEMENT

(75) Inventor: Frédéric Crettex, Prangins (CH)

(73) Assignee: Vaucher Manufacture Fleurier S.A., Fleurier (CH)

( * ) Notice: Subject to any disclaimer, the term of this patent is extended or adjusted under 35 U.S.C. 154(b) by 0 days.

(21) Appl. No.: 10/554,464

(22) PCT Filed: Apr. 16, 2004

(86) PCT No.: PCT/CH2004/000232

§ 371 (c)(1),
(2), (4) Date: Oct. 25, 2005

(87) PCT Pub. No.: WO2004/097535

PCT Pub. Date: Nov. 11, 2004

(65) Prior Publication Data

US 2006/0245302 A1 Nov. 2, 2006

(30) Foreign Application Priority Data

Apr. 25, 2003 (EP) ..... 03405292

(51) Int. Cl.
*G04B 19/24* (2006.01)

(52) U.S. Cl. ..... 368/28; 368/37

(58) Field of Classification Search ..... 368/28, 368/35–40

See application file for complete search history.

(56) References Cited

U.S. PATENT DOCUMENTS 3,258,907 A * 7/1966 Hamblin ..... 368/35
3,750,385 A * 8/1973 Kocher ..... 368/35
3,760,585 A * 9/1973 Wein ..... 368/35
3,811,266 A 5/1974 Samura
3,842,590 A 10/1974 Kato
4,632,569 A * 12/1986 Gogniat ..... 368/35
5,432,759 A * 7/1995 Vaucher ..... 368/28

FOREIGN PATENT DOCUMENTS

EP 1 351 105 A1 10/2003
FR 793 442 1/1936
GB 2 371 882 A 8/2002

OTHER PUBLICATIONS

PCT International Search Report, mailed Aug. 3, 2004 (6 pages).
Written Opinion for PCT/CH2004/000232 (6 pages).

* cited by examiner

*Primary Examiner*—Vit W. Miska
(74) *Attorney, Agent, or Firm*—Finnegan, Henderson, Farabow, Garrett & Dunner, LLP

(57) ABSTRACT

Embodiments of the present disclosure relate to a timepiece and a mechanism to be used with the timepiece for indicating the date and the day of the present time. In one embodiment, a timepiece may include a dial, indications of seven days of a week inscribed on the dial, and an aperture pierced through the dial and being sized to allow seven dates of a month to appear adjacent the indications on the dial. A mechanism for indicating the date and the day may include a date indicator bearing a series of dates from 1 to 31, a first member configured to cause the date indicator to move by seven days on each Sunday at about midnight, a date corrector bearing a series of dates from 1 to 6 and arranged in such a way that the date corrector can be partially superposed on the date indicator, and a second member configured to cause the date corrector to move in such a way that, at the end of a month having less than 31 days, the date corrector automatically hides incorrect dates and replaces them with its own dates.

14 Claims, 8 Drawing Sheets

DATE INDICATOR MECHANISM FOR WATCH MOVEMENT

FIELD OF THE INVENTION

The present invention relates to timepieces with a date display. It relates more specifically to a mechanism indicating the date and the day of the week intended to equip a watch movement.

DESCRIPTION OF RELATED ART

It is common practice, in mechanical and electromechanical watches, to display the date (1 to 31) and the day of the week (Monday to Sunday) using hands moving over the dial or using disks rotating under the dial, with their indications showing through windows.

In general, the only things visible each day are the date and the corresponding day. However, it may be advantageous to offer the wearer of the watch more information—the dates and the days over a period of one week such as a calendar offers, for example.

U.S. Pat. No. 3,811,266 proposes a solution that would meet this need. However, the operation of making the day and the date tally, which is an operation that is needed at the end of the months comprising fewer than 31 days, has to be done manually.

It is an object of the present invention to provide a mechanism that makes the operation of making the date and the day tally automatic.

BRIEF SUMMARY OF THE INVENTION

More specifically, according to a first embodiment, the invention relates to a mechanism indicating the date and the day, intended to equip a timepiece movement the dial of which is pierced with a window. It comprises:

- a date indicator bearing the series of dates from 1 to 31, said window being sized so as to allow seven dates to appear, with, inscribed facing them on the dial, the indications of the seven days of the week;
- first means for causing the date indicator to move on by seven days each Sunday at around about midnight;
- a date corrector bearing the series of dates from 1 to 6 and arranged in such a way that it can be partially superposed on the date indicator; and
- second means for causing the date corrector to move on in ways which allow it automatically, at the end of months comprising fewer than 31 days, to hide the incorrect dates and replace them with its own.

In this embodiment, the mechanism further comprises a hand intended to show the date corresponding to the day, said first means being arranged in such a way as to cause this hand to move on by one day each evening at around about midnight.

According to a second embodiment, the invention relates to a mechanism indicating the date and the day, intended to equip a timepiece movement the dial of which is pierced with a window. It comprises:

- a date indicator bearing the series of dates from 1 to 31;
- a day indicator positioned beside the date indicator and bearing the indications of the seven days of the week, said window being sized so as to show seven dates and seven days of the week;
- first means for causing these two indicators to move on by one position each evening at around about midnight;

- a date corrector bearing the series of dates from 1 to 6 and arranged in such a way that it can be partially superposed on the date indicator; and
- second means for causing the date corrector to move on in ways which allow it automatically, at the end of months comprising fewer than 31 days, to hide the incorrect dates and replace them with its own.

BRIEF DESCRIPTION OF THE DRAWINGS

Other features of the invention will emerge from the description which will follow, given with reference to the attached drawing, in which.

DETAILED DESCRIPTION OF THE INVENTION

Figure 1:
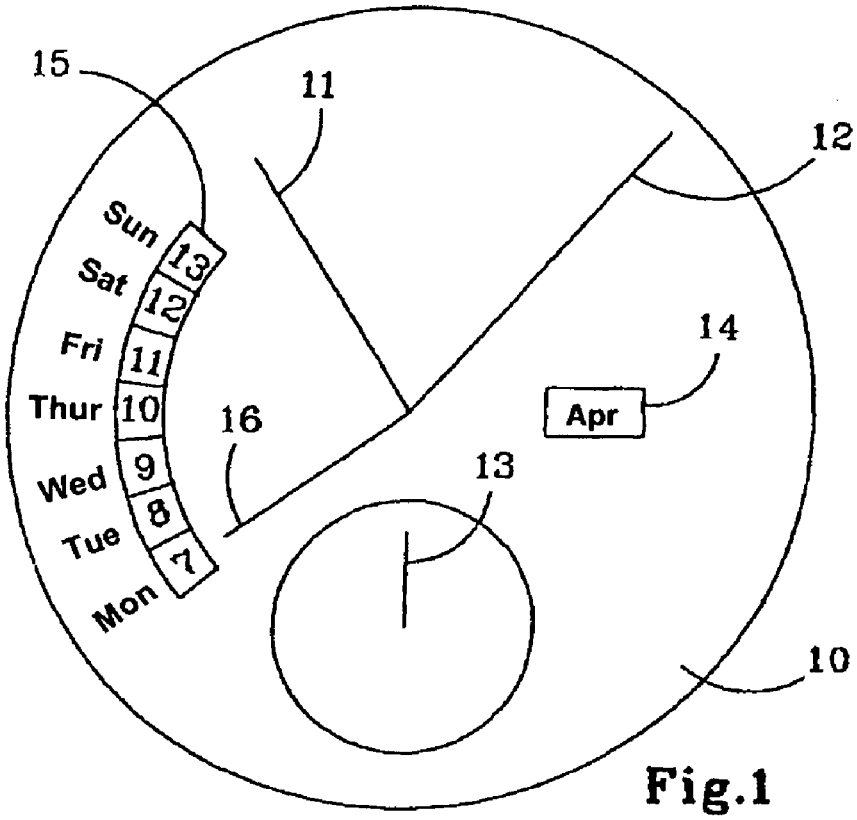
FIGS. 1 and 2 are schematic overall views of a timepiece equipped with the first embodiment of the mechanism according to the invention.
Figure 2:
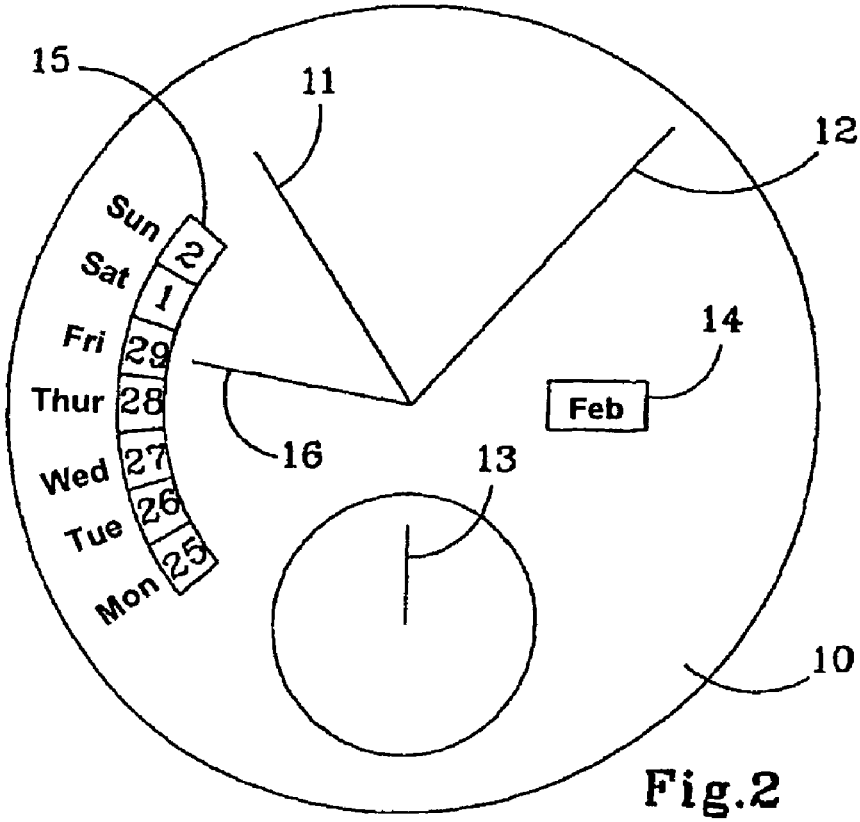

The timepiece depicted schematically in FIGS. 1 and 2 is intended to display, on a dial 10, the hours, minutes and seconds of the current time, and also the date and the month.

The hours and minutes are displayed at the center of the timepiece by big hands 11 and 12 respectively, while the seconds are displayed, at the 6 o'clock position, by a small hand 13. The month is displayed using a disk visible behind a window 14 in the 3 o'clock position. These functions will not be described because they are provided in a conventional way and are not the subject of the invention.

The description will therefore essentially devote itself to describing the display of the date which, according to a preferred embodiment of the invention, is done through a window 15 in the shape of an arc of a circle concentric with the hands 11 and 12, located at the 9 o'clock position. This window shows seven dates facing which there are inscribed, on the dial, from the bottom up, the indications of the seven days of the week. A hand 16, also concentric with the hands 11 and 12 and pointing toward the window 15 is used to indicate the date of each day of the week.

The peculiar feature of this timepiece lies in the mechanism that allows the correct date to be displayed automatically each day in the window 15 by the hand 16 against the correct day of the week, whether the current month comprises 31, 30, 29 or 28 days. FIG. 2 shows, for example, the state of the timepiece on February 29 of a leap year.

Reference is now made to FIGS. 3 to 7 which schematically depict, in various configurations, the constituent parts of the mechanism with which the timepiece of FIGS. 1 and 2 is equipped. It forms a module arranged on a conventional movement and coupled to the latter using any technique well known to those skilled in the art.

The figures show a date indicator 17 consisting, in the known way, of a disk crown the top face of which bears the thirty-one dates visible in series of seven through the window 15 against the series of the seven days of the week. The internal part of the crown 17 is provided with thirty-one teeth used, on the one hand, for driving it via means which will be described later and, on the other hand, for positioning it using a conventional jumper, not depicted.

The mechanism comprises a twenty-four-hour wheel 18 driven in the counterclockwise direction (hereafter termed CCW direction) at one revolution per day, from the hours wheel of the movement. The wheel 18 bears, on the top, a stud 19 engaging with a thirty-one star 20 positioned at the center of the movement and the pinion 21 of which bears the date-indicating hand 16. The star 20 bears, on its underside, a stud 22, the purpose of which will become apparent later on.

The pinion 21 meshes with a first rack 23 forming the end of an arm 24 which pivots about a pin 25. When the arm pivots in the CCW direction, it loads a spring 26. The other end of this arm is equipped with a second rack 27 which meshes with a clutch runner with pawl 28, of a type well known to those skilled in the art, collaborating with the internal tooth set of the date indicator 17. The rack 27 has no effect on this runner when it pivots in the CCW direction, but when it pivots in the clockwise direction (hereinafter termed the CW direction), it drives the latter in such a way as to cause the indicator 17 to move on in the CCW direction.

A pawl 29, acting under the effect of a spring 30, serves, via one of its ends, to prevent the thirty-one star 20 from rotating in the CCW direction. The other end of this pawl is provided with a slot into which a stud 31 fits. The latter is fixed to one end of a pivoting lever 32 the other end of which is arranged in such a way as to lie in the path of the stud 22 fitted to the thirty-one star 20. The lever 32 is subjected to the action of a spring 33 which tends to return its free end toward the center of the movement.

Figure 3:
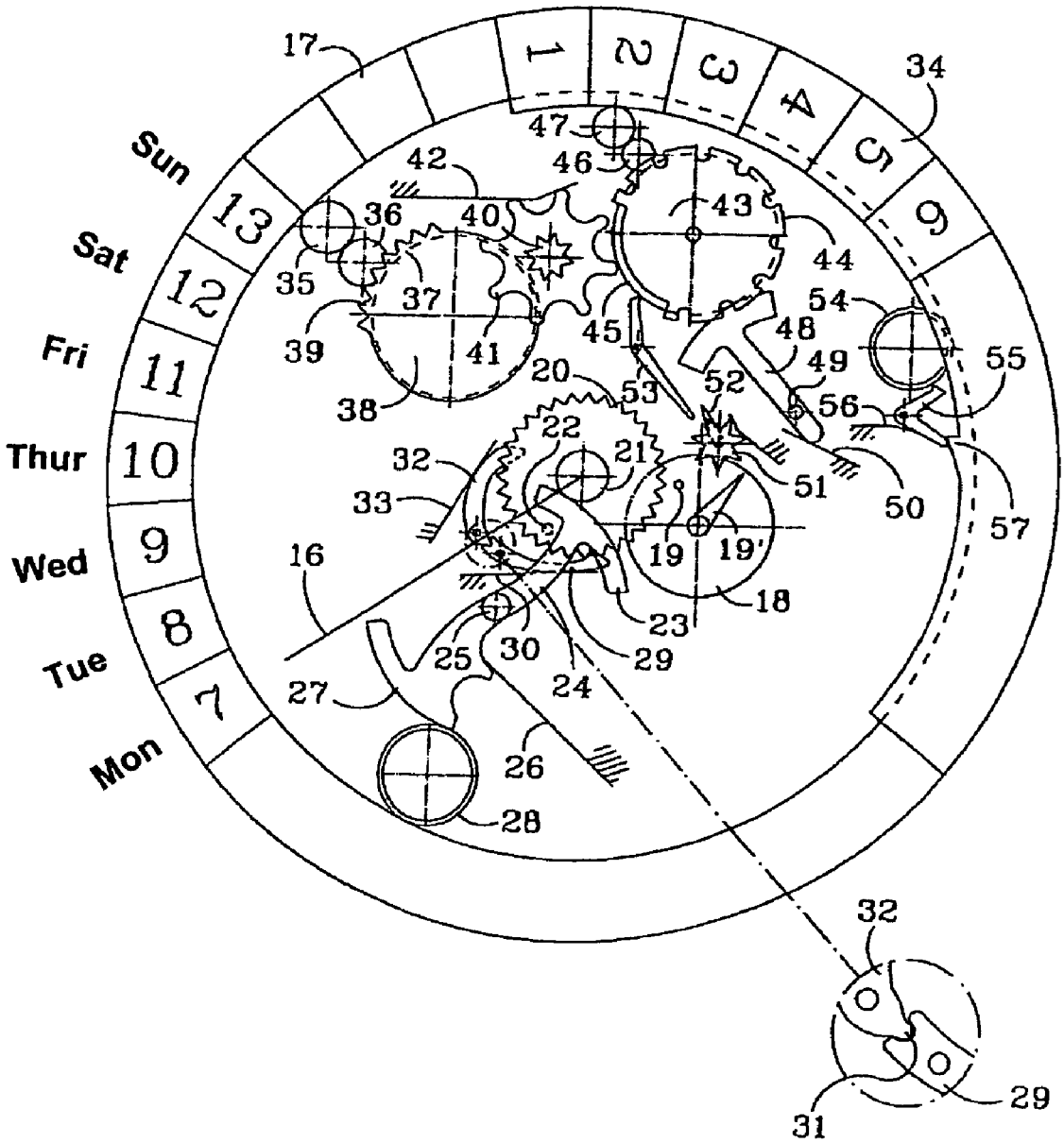
FIGS. 3 to 7 depict this mechanism in various of its most significant states.
Figure 4:
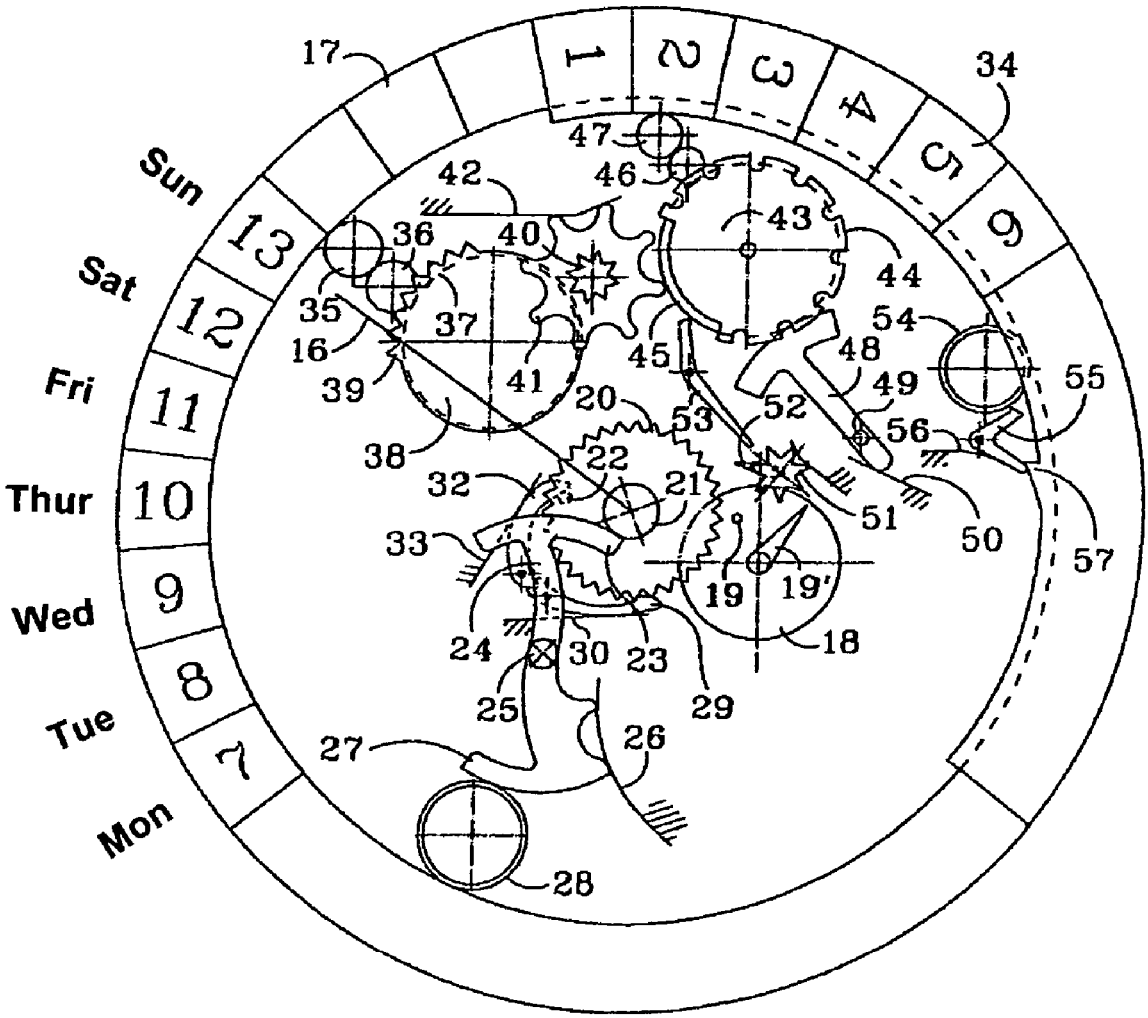

In operation, the mechanism, during the night from Sunday to Monday, after the jump at midnight, is in the position illustrated by FIG. 3 for the week running from Monday 7 to Sunday 13. The hand 16 therefore points toward the date of the Monday. On each of the subsequent evenings, at around about midnight, the stud 19 will therefore cause the thirty-one star 20 to move on by one position, with its stud 22 and its hand 16 which, thus, on Sunday evening, will point toward the 13, as shown in FIG. 4.

Figure 5:
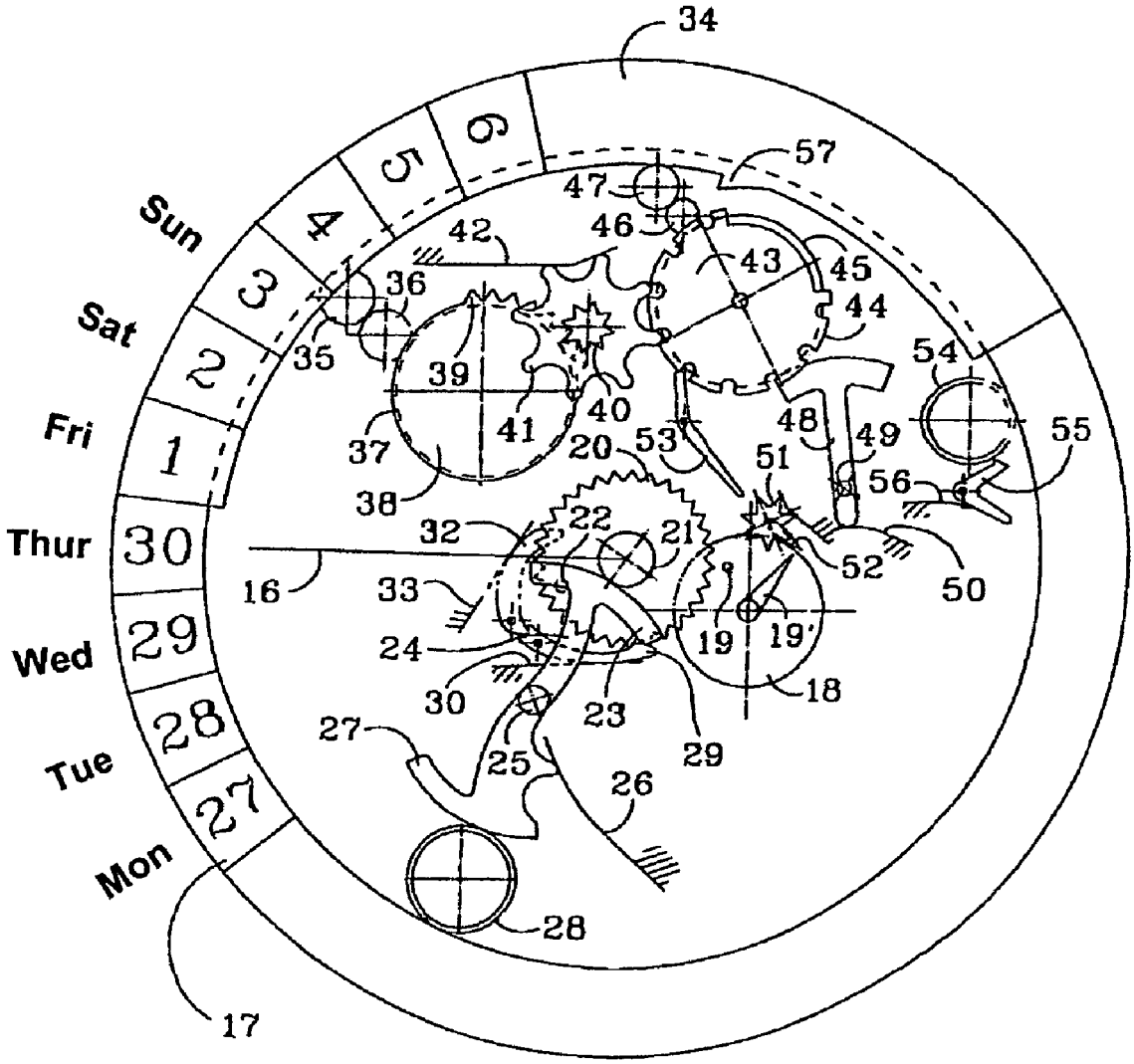

Throughout the week, the first rack 23 has therefore also progressed in the CCW direction, loading its spring 26 while the stud 22 has moved closer to the end of the lever 32. The second rack 27 has also progressed in the same direction but, as already mentioned, because of the presence of the clutch runner 28, has had no effect on the date indicator 17 which has therefore remained immobile. By way of indication, FIG. 5 shows the state of the mechanism on Thursday.

Each Sunday evening, at the time when the stud 19 causes the mechanism to progress by one position, the stud 22 lifts the end of the lever 32, the stud 31 of which moves the pawl 29 away from the thirty-one star 20. The latter, actuated by the rack 23 subjected to the effect of the spring 26 quickly returns, in the CW direction, with its hand 16, to the initial Monday-morning position depicted in FIG. 3.

At that moment, the hand 16 once again indicates Monday and the first of the new seven visible dates of the week beginning. A further seven-day cycle then begins, identical to the one just described.

The mechanism would be perfect if all the months comprised 31 days. As this is not the case, the date indication designated by the hand 16 will not be correct in months comprising fewer than 31 days. Thus, for example, in a 30-day month ending on a Thursday, the date in the Friday position will be the 31, whereas it should be the 1.

One solution that comes immediately to mind as a way of solving this problem is to act upon the date indicator 17 using a manual correction mechanism well known to those skilled in the art, by virtue of which the indicator is moved on by three, two or one step respectively at the end of 29-day, 28-day or 30-day months. Although this solution does admittedly allow the remaining days of the week to be made to tally with the dates, the same is not true of the days which have passed, which will no longer display the correct date.

The mechanism according to the present invention provides a solution to the problem by making it possible automatically to cause the indication of the day and that of the date to be made to tally perfectly and automatically at the end of months comprising fewer than 31 days.

To do this, the mechanism uses a corrector 34 in the form of a sector of a disk crown 31 centered on the movement, having the same radius as the indicator 17. On its left-hand part it bears the series of dates from 1 to 6 and is dimensioned so that it can be superposed precisely on the indicator 17 so as to hide the incorrect dates and replace them with its own. The sector 34 is provided, toward the inside, with a tooth set used to drive it.

For reasons that will become apparent later on, the corrector 34 is, in its initial state, illustrated by FIGS. 3 and 4, offset by three positions with respect to the last date appearing in the window 15.

According to the embodiment described, a first manual setting performed prior to the Sunday evening preceding the end of a month comprising fewer than 31 days allows the corrector 34 to be brought up close to the last of the dates visible in the window 15. This setting is by 1 position in 30-day months, by 2 positions in 29-day months and 3 positions in 28-day months. In other words, the date 1 on the corrector is brought up to 2, 1 and 0 positions respectively at the end of 30-day, 29-day and 28-day months.

A second setting operation needs to be performed, advantageously at the same time as the first, so as to cause the date indicator 17 to advance by 1, 2 or 3 positions respectively for 30-day, 29-day and 28-day months.

FIGS. 3 and 4 depict the mechanism before the two setting operations. When these operations have been performed, the mechanism according to the invention must therefore, at the start of the last week of months comprising fewer than 31 days, that is to say when moving on from Sunday to Monday, allow the correction sector 34 to be moved automatically by a number of positions which depends on the date of the Monday between 23 and 30. This number of positions is 1, 2, 3, 4, 5, 6, 7 or 8 according to whether the last Monday is the 23, 24, 25, 26, 27, 28, 29 or 30 respectively. The mechanism must also of course automatically return the corrector 34 to its initial state on the next Sunday evening.

In order to allow these movements to be performed, the mechanism has, as its starting point, the internal tooth set of the date indicator 17 which, by means of two runners 35 and 36, meshes with an associated wheel 37, above it, having a thirty-one star 38. The latter has the peculiar feature of having just eight of the thirty-one teeth that it normally should have, these being distributed normally over a sector 39 of about 93° and corresponding to operations to be performed between 23 and 30 of months comprising fewer than 31 days. The rest of the periphery of the star is plane.

The eight-toothed sector 39 meshes with a pinion 40 the circumference of which is equal to the length of the arc of the circle of the sector 39, which is positioned in such a way as to begin to operate the pinion at the start of the 23 of the month. This pinion is associated with an eight-tooth wheel 41 held in place by means of a jumper 42 and meshing with a correcting wheel 43 which has the peculiar feature of having a nine-notch sector 44 with a spacing corresponding to that of the teeth of the wheel 41. Three of these notches, bearing the references n1, n2 and n3, correspond to the corrections to be carried out at the end of the 30-day, 29-day and 28-day months, while the other six, bearing the references n4 to n9, are used to correct the days. The remainder of the periphery of the correcting wheel 43 is free of teeth.

The wheel 43 is associated, underneath it, with a wheel 45 meshing, via two runners 46 and 47, with the internal tooth set of the correction section 34.

The wheel 45 meshes with a rack 48 forming the end of an arm which pivots about a pin 49. When the pivoting is in the CW direction, it loads a spring 50.

A seven-day star 51 is driven, at one revolution per week, by a finger 19' borne, like the stud 19, by the twenty-four-hour wheel 18. This star is provided with a tooth 52 which acts on a pawl 53 allowing the wheel 45 to rotate, in the CCW direction, under the action of the spring 50, each Sunday at around about midnight.

A barrel 54 is enmeshed with the internal tooth set of the date indicator 17 on which it acts only when it turns in the CCW direction. It is associated with a retaining pawl 55, subjected to the thrust of a spring 56 and actuated by a tooth 57 formed on the inside of the straight part of the corrector 34.

Finally, manual correction means, not depicted on the drawing in order not to clutter this drawing, but which are well known to those skilled in the art, allow the correcting wheel 43 and the barrel 54 to act simultaneously so as to move, in the CCW and the CW directions respectively, though 3, 2 and 1 steps before the end of 28-day, 29-day and 30-day months respectively. These corrections correspond to the respective settings of the corrector 34 and of the indicator 17 which were mentioned earlier.

Figure 6:
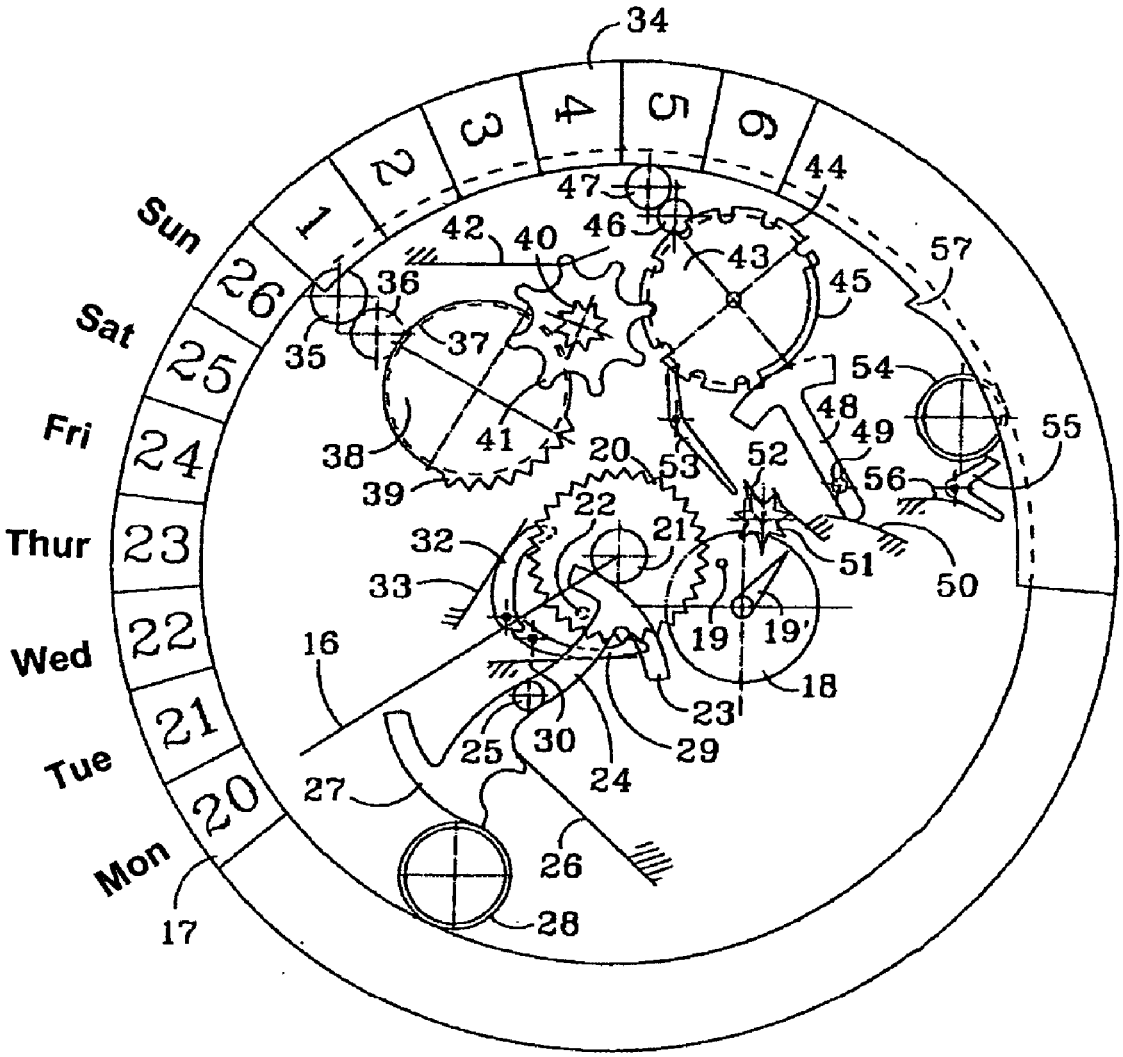
Figure 7:
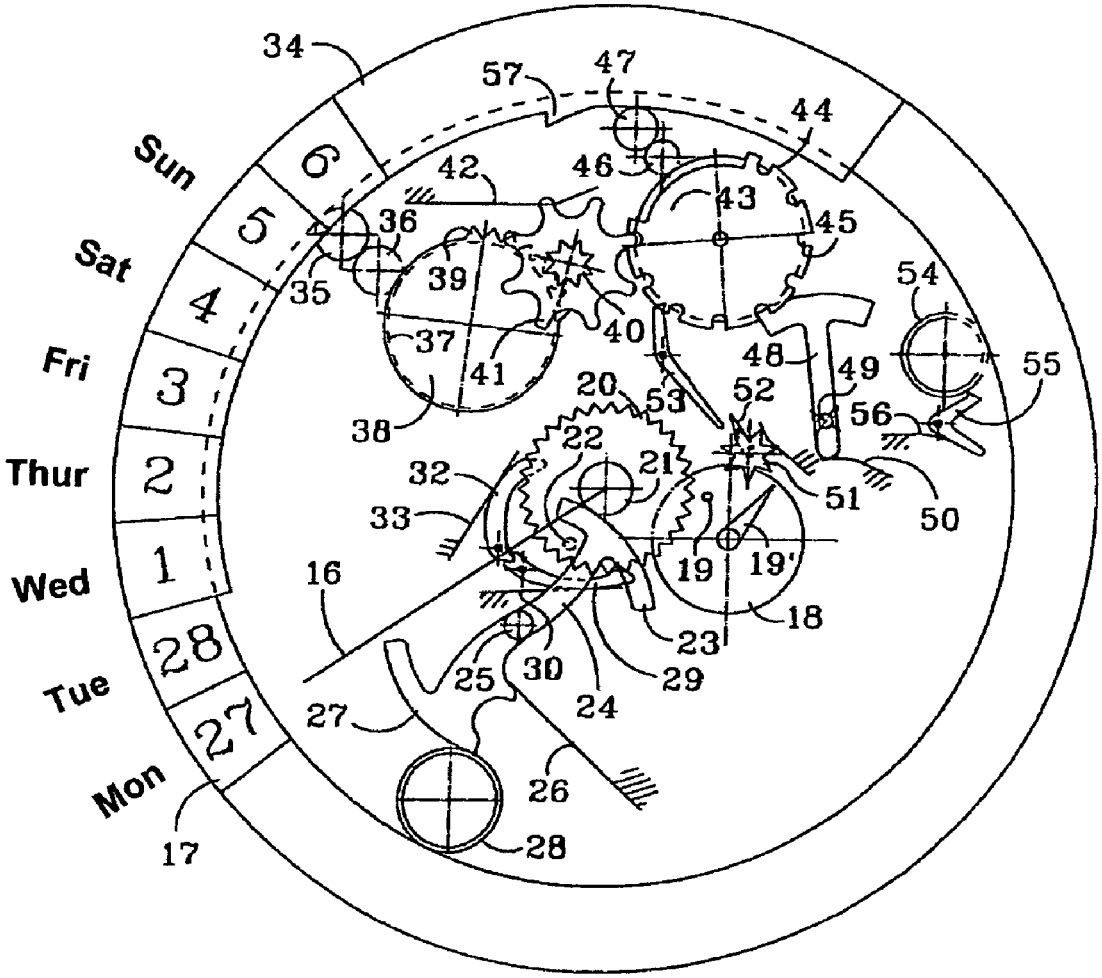

The way in which the mechanism works which, automatically, ensures that the corrector 34 is correctly positioned, will be described with more especial reference to FIGS. 5, 6 and 7 which relate respectively to Thursday 30 of a 30-day month, Monday 20 of a 28-day month of February and Monday 27 of a 28-day month of February.

When, at the time of moving on from the 22 to 23 of 31-day months, the eight-tooth sector 39 acts on the pinion 40, the eight-tooth wheel 41 associated with it rotates freely because the correcting wheel 43 is not presenting it with its nine-notch sector 44. The corrector 34 therefore remains immobile during the switch from the 31 to the 1 of the month.

This will be the situation as long as no position setting has been performed by the wearer of the watch during the course of the month in order to prepare the corrector 34 and the barrel 54 for a month comprising fewer than 31 days.

If the double position setting operation has been performed, in the case, for example, of a 30-day month, the correcting wheel 43 has advanced by one position in the CCW direction. On the Sunday evening, when the indicator 17 jumps by seven positions, the notch n 2 of the wheel 43 and following notches may thus mesh with the eight-tooth wheel 41. All will then be determined by the date of the following Monday.

According to the arrangements described hereinabove, if the Monday is the 23, 24, 25, 26, 27, 28, 29 or 30, the correcting wheel 43 will advance by 1, 2, 3, 4, 5, 6, 7 or 8 positions respectively, thus causing the corrector 34 to progress by the same number of positions so as to hide the incorrect dates displayed by the indicator 17 and replace them with a correct indication of the date.

The same sequence of movements is performed for 29-day and 28-day months, once the manual setting has caused the correcting wheel 43 to advance by 2 or 3 positions.

Of course, the operations which have just been described need to have been preceded, on the Sunday evening, by return of the corrector 34 to its initial state, offset by 3 positions with respect to the last date visible in the window 15.

This return to the initial state is triggered by the seven-day star 51, the tooth 52 of which lifts the pawl 53, thus releasing the wheel 45. The latter, actuated by the rack 48 subjected to the action of the spring 50 then quickly returns, in the CCW direction, to its starting position. The correcting wheel 43 associated with it, acting via the runners 46 and 47, thus causes the corrector 34 also to return to its initial state.

At the time when the corrector 34 moves aside to return to its initial position, the pawl 55 which, hitherto, had been immobilizing the barrel 54, is raised by the tooth 57. The barrel therefore finds itself released and causes the indicator 17 to advance by 1, 2 or 3 positions depending on whether the month comprises 30, 29 or 28 days.

Thus, a date indicator mechanism that displays together and automatically, from Monday through Sunday, the dates of the seven days of the week against the corresponding days, whether the month comprises 31, 30, 29 or 28 days, has been proposed.

The present description has been given with reference to a fixed indication the days of the week, from Monday through Sunday, and of a date indicator which jumps by seven positions, the date being shown by a hand.

Figure 8:
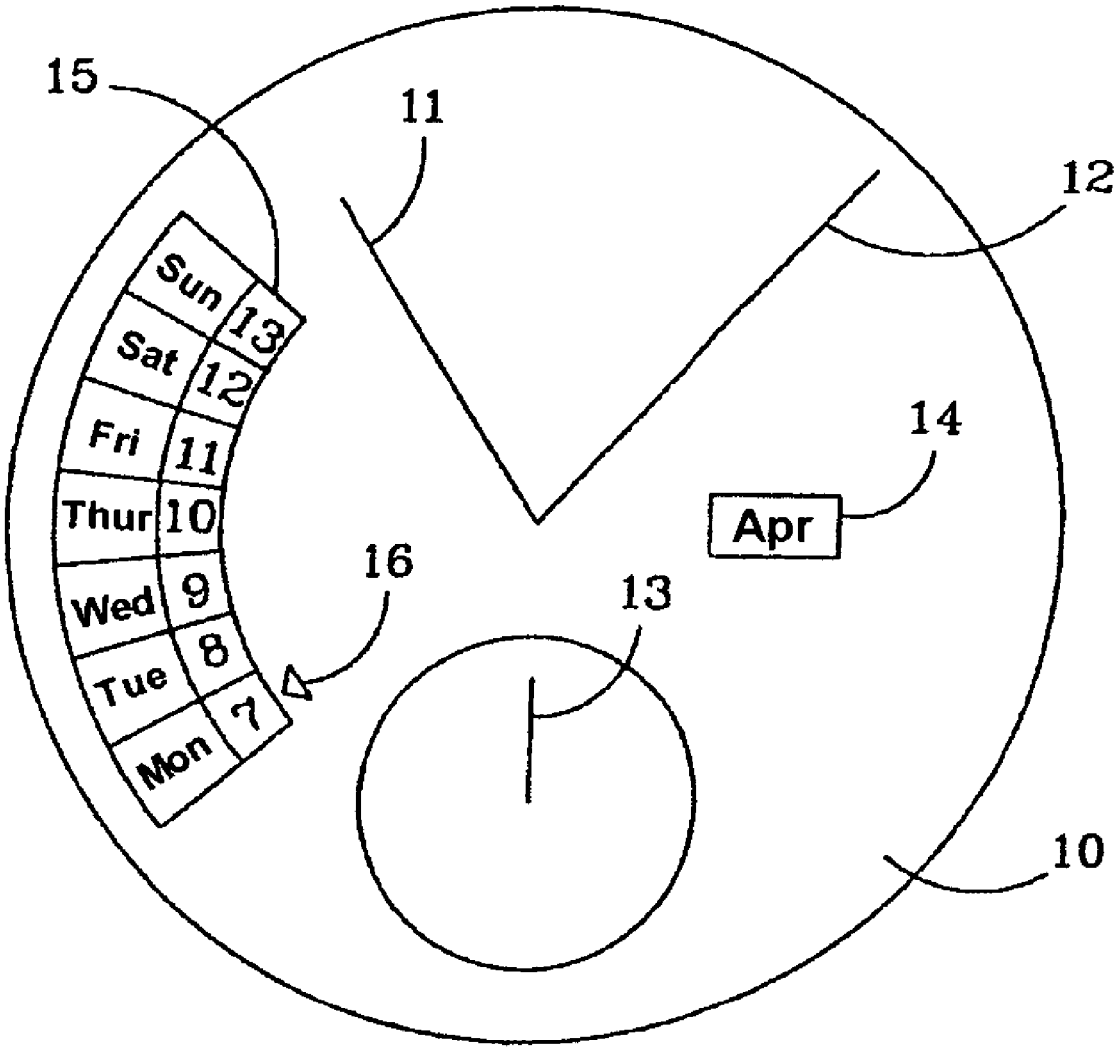
FIG. 8 is an overall view of a timepiece provided with the second embodiment of the mechanism.

However, it goes without saying that, without departing from the scope of the invention, the mechanism could, as illustrated by FIG. 8, while retaining the principle of a day-date display over seven days, have a day indicator and a date indicator that advance by one position each day, both visible behind the window 15, the correct day-date pair always being the one at the bottom of the scale without the need for it to be designated by a hand.

The display could also be done over two weeks or, more generally, over n days. In such a case, the corrector would need to bear dates from 1 to n-1.

Figure 9:
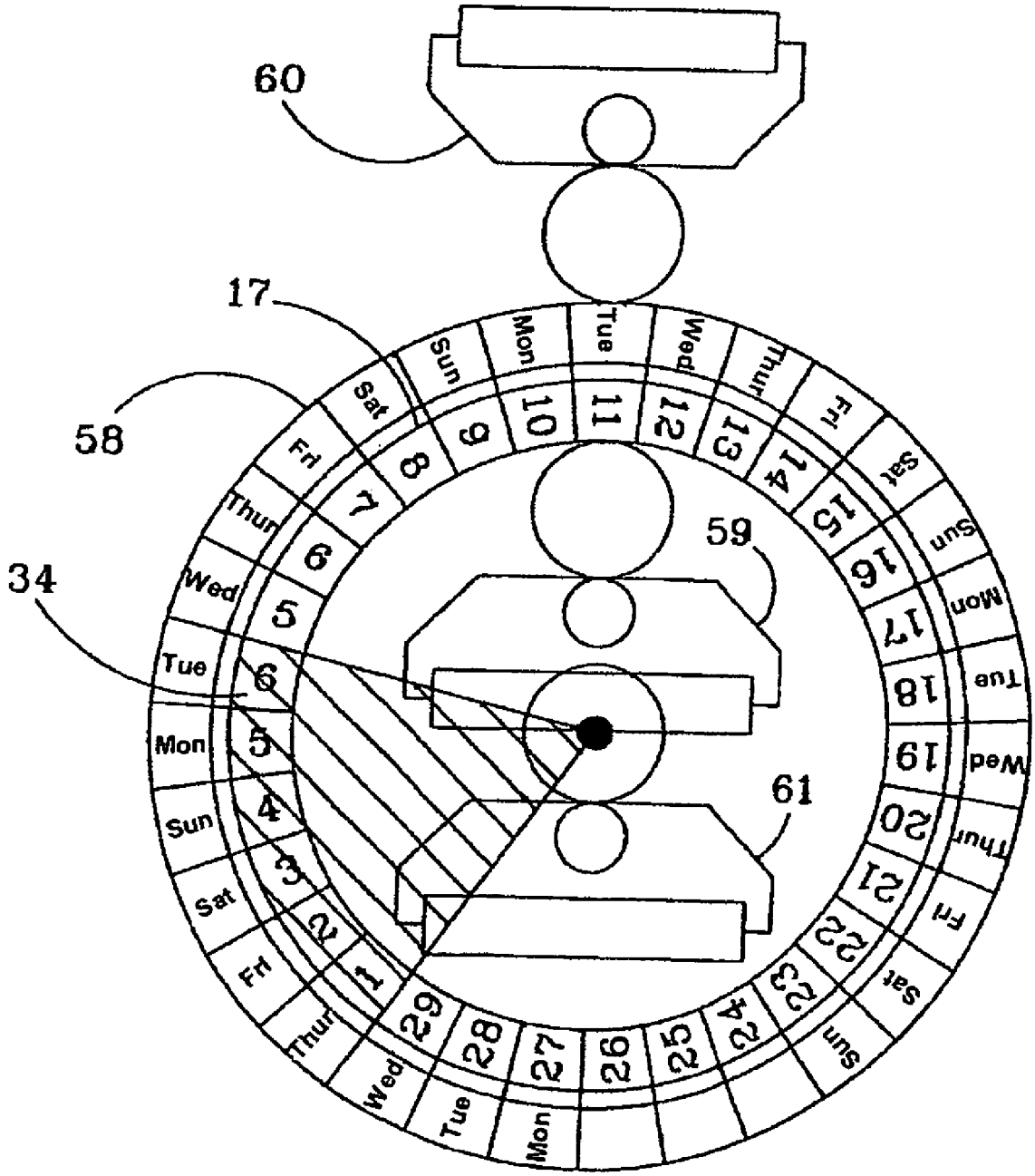
FIG. 9 illustrates the way in which the indicator members of FIG. 8 can be driven electronically.

The invention has just been described in a mechanical embodiment but it is obvious that the functions of the mechanism could also be performed electronically, as illustrated for example in FIG. 9.

In such a case, according to an embodiment corresponding, for example, to that of FIG. 8, the date indicator 17 is surrounded by a disk crown 58 the top face of which bears four series of indications of the seven days of the week, both visible through the window 15. The corrector 34 then adopts the form of a sector of a disk centered on the movement. These three components are rotationally driven by three stepping motors 59, 60 and 61 respectively which are controlled by a microprocessor (not depicted) programmed appropriately by the person skilled in the art so as, on the one hand, to cause the date indicator 17 and the day indicator 58 to advance by one position each evening and, on the other hand, to position the corrector 34 in such a way that, at the end of months comprising fewer than 31 days, it hides the incorrect dates and replaces them with its own.

What is claimed is:

1. A timepiece, comprising:

a dial with indications of seven days of a week inscribed on the dial;

an aperture pierced through the dial and being sized to allow seven dates of a month from D day to D+7 day to appear adjacent the indications on the dial; and a mechanism driven by a movement for indicating the date and the day comprising:

a date indicator bearing a series of dates from 1 to 31;

a first member configured to cause the date indicator to move by seven days between the D+7 day of a first week and D day of the following week;

a date corrector bearing a series of dates from 1 to 6 and arranged in such a way that the date corrector can be partially superposed on the date indicator; and a second member configured to cause the date corrector to move in such a way that, at the end of a month having less than 31 days, the date corrector automatically hides incorrect dates and replaces them with its own dates.

2. The timepiece as claimed in claim 1, wherein the indications inscribed on the dial comprise the seven days of the week from Monday to Sunday, and wherein the first member is configured to cause the date indicator to move by seven days on each Sunday at about midnight.

3. The timepiece as claimed in claim 1, further comprising a hand configured to show the date corresponding to the day, and wherein the first member is configured to cause the hand to move by one day on each evening at about midnight.

4. The timepiece as claimed in claim 2, further comprising a hand configured to show the date corresponding to the day, and wherein the first member is configured to cause the hand to move by one day on each evening at about midnight.

5. A mechanism for indicating a date in a timepiece, the timepiece including a dial with indications of seven days of a week inscribed on the dial and an aperture pierced through the dial, the aperture being sized to allow seven dates of a month from D day to D+7 day to appear adjacent the indications on the dial, the mechanism comprising:

a date indicator bearing a series of dates from 1 to 31;

a first member configured to cause the date indicator to move by seven days between the end of a week and the beginning of the following week;

a date corrector bearing a series of dates and arranged in such a way that the date corrector can be partially superposed on the date indicator; and a second member configured to cause the date corrector to move in such a way that, at the end of a month having less than 31 days, the date corrector automatically hides incorrect dates and replaces them with its own dates.

6. The mechanism as claimed in claim 5, wherein at least one of the first and second members comprises purely mechanical components.

7. The mechanism as claimed in claim 5, wherein at least one of the first and second members comprises purely electro-mechanical components.

8. A mechanism for indicating a date in a timepiece, the timepiece comprising a dial with indications of seven days of a week from Monday to Sunday inscribed on the dial and an aperture pierced through the dial, the aperture being sized to allow seven dates of a month from D day to D+7 day to appear adjacent the indications on the dial, the mechanism comprising:

a date indicator bearing a series of dates from 1 to 31;

first means for causing the date indicator to move by seven days on each Sunday at about midnight;

a date corrector bearing a series of dates from 1 to 6 and arranged in such a way that the date corrector can be partially superposed on the date indicator; and second means for causing the date corrector to move in such a way that, at the end of a month having less than 31 days, the date corrector automatically hides incorrect dates and replaces them with its own dates.

9. A timepiece, comprising:

a dial;

an aperture pierced through the dial and being sized to allow a number n of dates of a month and a sequence of n days of a week to appear on the dial; and a mechanism driven by a movement for indicating the date and the day comprising:

a date indicator bearing a series of dates from 1 to 31;

a day indicator positioned beside the date indicator and bearing indications of seven days of the week;

first means for causing the date indicator and the day indicator to move by one position on each evening at about midnight;

a date corrector bearing a series of dates from 1 to n-1 and arranged in such a way that the date corrector can be partially superposed on the date indicator; and second means for causing the date corrector to move in such a way that, at the end of a month having less than 31 days, the date corrector automatically hides incorrect dates and replaces them with its own dates.

10. The timepiece as claimed in claim 9, wherein the aperture is sized to show seven dates of the month and seven days of the week, and wherein the date corrector bears the series of dates from 1 to 6.

11. A mechanism for indicating a date and a day in a timepiece, the timepiece comprising a dial and an aperture pierced through the dial, the aperture being sized to allow a number n of dates of a month and a sequence of n days of a week to appear on the dial, the mechanism comprising:

a date indicator bearing a series of dates from 1 to 31;

a day indicator positioned beside the date indicator and bearing indications of seven days of the week;

a first member configured to cause the date indicator and the day indicator to move by one position on each evening at about midnight;

a date corrector bearing a series of dates and arranged in such a way that the date corrector can be partially superposed on the date indicator; and a second member configured to cause the date corrector to move in such a way that, at the end of a month having less than 31 days, the date corrector automatically hides incorrect dates and replaces them with its own dates.

12. The mechanism as claimed in claim 11, wherein at least one of the first and second members comprises purely mechanical components.

13. The mechanism as claimed in claim 11, wherein at least one of the first and second members comprises purely electro-mechanical components.

14. A mechanism for indicating a date and a day in a timepiece, the timepiece comprising a dial and an aperture pierced through the dial, the aperture being sized to allow seven dates of a month and seven days of a week to appear on the dial, the mechanism comprising:

a date indicator bearing a series of dates from 1 to 31;

a day indicator positioned beside the date indicator and bearing indications of the seven days of the week;

first means for causing the date indicator and the day indicator to move by one position on each evening at about midnight;

a date corrector bearing a series of dates from 1 to 6 and arranged in such a way that the date corrector can be partially superposed on the date indicator; and second means for causing the date corrector to move in such a way that, at the end of a month having less than 31 days, the date corrector automatically hides incorrect dates and replaces them with its own dates.

* * * * *